US011423845B2

(12) United States Patent
Kwon et al.

(10) Patent No.: US 11,423,845 B2
(45) Date of Patent: Aug. 23, 2022

(54) SOURCE DRIVER INTEGRATED CIRCUIT TRANSMITTING SENSING DATA BASED ON CASCADE MANNER, DISPLAY DEVICE INCLUDING THE SAME, AND METHOD OF OPERATING DISPLAY DEVICE

(71) Applicant: SILICON WORKS CO., LTD., Daejeon (KR)

(72) Inventors: You Jin Kwon, Daejeon (KR); Sang Kwon Kim, Daejeon (KR); Chang Sung Hong, Daejeon (KR); Pyeong Keun Oh, Daejeon (KR); Jun Ho Kwak, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/155,561

(22) Filed: Jan. 22, 2021

(65) Prior Publication Data

US 2021/0241700 A1 Aug. 5, 2021

(30) Foreign Application Priority Data

Jan. 31, 2020 (KR) ..... 10-2020-0011453

(51) Int. Cl.
*G09G 3/3275* (2016.01)

(52) U.S. Cl.
CPC ... *G09G 3/3275* (2013.01); *G09G 2300/0408* (2013.01); *G09G 2310/08* (2013.01); *G09G 2370/08* (2013.01)

(58) Field of Classification Search
CPC ..... G09G 2300/0408; G09G 2310/08; G09G 2320/0223; G09G 2320/0295; G09G 2320/045; G09G 2370/08; G09G 3/3275
See application file for complete search history.

(56) References Cited

U.S. PATENT DOCUMENTS

| | | | | |
|---|---|---|---|---|
| 11,030,950 | B2 * | 6/2021 | Kwon | G09G 3/3275 |
| 2001/0013850 | A1 * | 8/2001 | Sakaguchi | G09G 3/3688 345/87 |
| 2008/0180365 | A1 * | 7/2008 | Ozaki | G09G 3/3233 345/76 |
| 2010/0277400 | A1 * | 11/2010 | Jeong | G09G 3/3275 345/76 |
| 2016/0125794 | A1 * | 5/2016 | Park | G09G 3/2096 345/522 |

(Continued)

FOREIGN PATENT DOCUMENTS

KR 2001-0070251 A 7/2001

*Primary Examiner* — Ram A Mistry
(74) *Attorney, Agent, or Firm* — Harness, Dickey & Pierce, P.L.C.

(57) ABSTRACT

Provided are a source driver integrated circuit (IC) according to the present disclosure including a first buffer in which first sensing data transmitted from a first source driver IC is stored, a sensing data generation circuit configured to sense a characteristic of a driving element included in each pixel and generate second sensing data, a second buffer in which the second sensing data is stored, a control circuit configured to generate a selection signal in response to an operation command, and a selector configured to transmit one of the first sensing data stored in the first buffer and the second sensing data stored in the second buffer to a second source driver IC in response to the selection signal.

16 Claims, 8 Drawing Sheets

(56) References Cited

U.S. PATENT DOCUMENTS

2016/0189595 A1* 6/2016 Choi ..... G09G 3/2018
345/212
2016/0189617 A1* 6/2016 Park ..... G09G 5/10
345/690

* cited by examiner

SOURCE DRIVER INTEGRATED CIRCUIT TRANSMITTING SENSING DATA BASED ON CASCADE MANNER, DISPLAY DEVICE INCLUDING THE SAME, AND METHOD OF OPERATING DISPLAY DEVICE

CROSS-REFERENCE TO RELATED APPLICATIONS

This application claims the benefit of the Korean Patent Application No. 10-2020-0011453 filed on Jan. 31, 2020 which is hereby incorporated by reference as if fully set forth herein.

FIELD

The present disclosure relates to a display device, and more particularly, to an organic light-emitting diode (OLED) display device.

BACKGROUND

Display panels deliver various visual information to a human through images. A display driver integrated circuit (IC) is a semiconductor chip used to drive a plurality of pixels included in a light-emitting diode (LED) display panel, an organic LED (OLED) display panel, and a liquid crystal display (LCD) panel.

The display driver IC may be classified into a display driver IC for a mobile device used in a mobile device such as a smart phone and a display driver IC for a medium- to large-sized product used in a medium- to large-sized electronic product such as a tablet personal computer (PC) or a television (TV).

The display driver IC includes a plurality of gate driver ICs and a plurality of source driver ICs. The plurality of gate driver ICs perform a role of turning on and off pixels, and the plurality of source driver ICs perform a role of generating differences in colors to be expressed by the pixels.

When the above-described display driver IC is applied to an OLED display panel, the plurality of source driver ICs sense characteristic information (e.g., threshold voltage or mobility) of driving transistors formed in each pixel and transmit the characteristic information to a timing controller.

However, a physical length at which sensing data is transmitted is inevitably different depending on a position at which each of the source driver ICs is disposed on the OLED display panel. Accordingly, a time required for each source driver IC to transmit the sensing data may also be inevitably different, and thus there is a problem that difficulties may arise when the timing controller processes the sensing data.

SUMMARY

The present disclosure is directed to providing a source driver integrated circuit (IC) capable of selectively outputting sensing data received from a previous source driver IC or self-sensing data in response to a control command, a display device including the same, and a method of operating the display device.

The present disclosure is also directed to providing a source driver IC that enables a timing controller to receive sensing data acquired by a plurality of source driver ICs through a single source driver IC, a display device including the same, and a method of operating the display device.

According to an aspect of the present disclosure, there is provided a source driver IC including a first buffer in which first sensing data transmitted from a first source driver IC is stored, a sensing data generation circuit configured to sense a characteristic of a driving element included in each pixel and generate second sensing data, a second buffer in which the second sensing data is stored, a control circuit configured to generate a selection signal in response to an operation command, and a selector configured to transmit one of the first sensing data stored in the first buffer and the second sensing data stored in the second buffer to a second source driver IC in response to the selection signal.

According to another aspect of the present disclosure, there is provided a display device including a data driving circuit block including a plurality of source driver integrated circuits (ICs) each configured to sense a characteristic of a driving element included in each pixel and obtain sensing data, wherein each of the plurality of source driver ICs includes a first source driver IC connected to a first pixel and configured to transmit first sensing data, which is obtained by sensing a characteristic of a driving element included in the first pixel, to a timing controller when a first transmission command is received from the timing controller, and a second source driver IC connected to a second pixel and configured to transmit second sensing data, which is obtained by sensing a characteristic of a driving element included in the second pixel, to the first source driver IC when the first transmission command is received.

According to still another aspect of the present disclosure, there is provided a method of operating a display device including a timing controller, a first source driver integrated circuit (IC) connected to a first pixel group, and a second source driver IC connected to a second pixel group, the method including generating first sensing data by sensing pixels included in the first pixel group by the first source driver IC and generating second sensing data by sensing pixels included in the second pixel group by the second source driver IC in response to a sensing command output from the timing controller, transmitting the first sensing data to the timing controller by the first source driver IC and transmitting the second sensing data to the first source driver IC by the second source driver IC in response to a first transmission command output from the timing controller, and transmitting the second sensing data, which is transmitted from the second source driver IC, to the timing controller by the first source driver IC in response to a second transmission command output from the timing controller.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
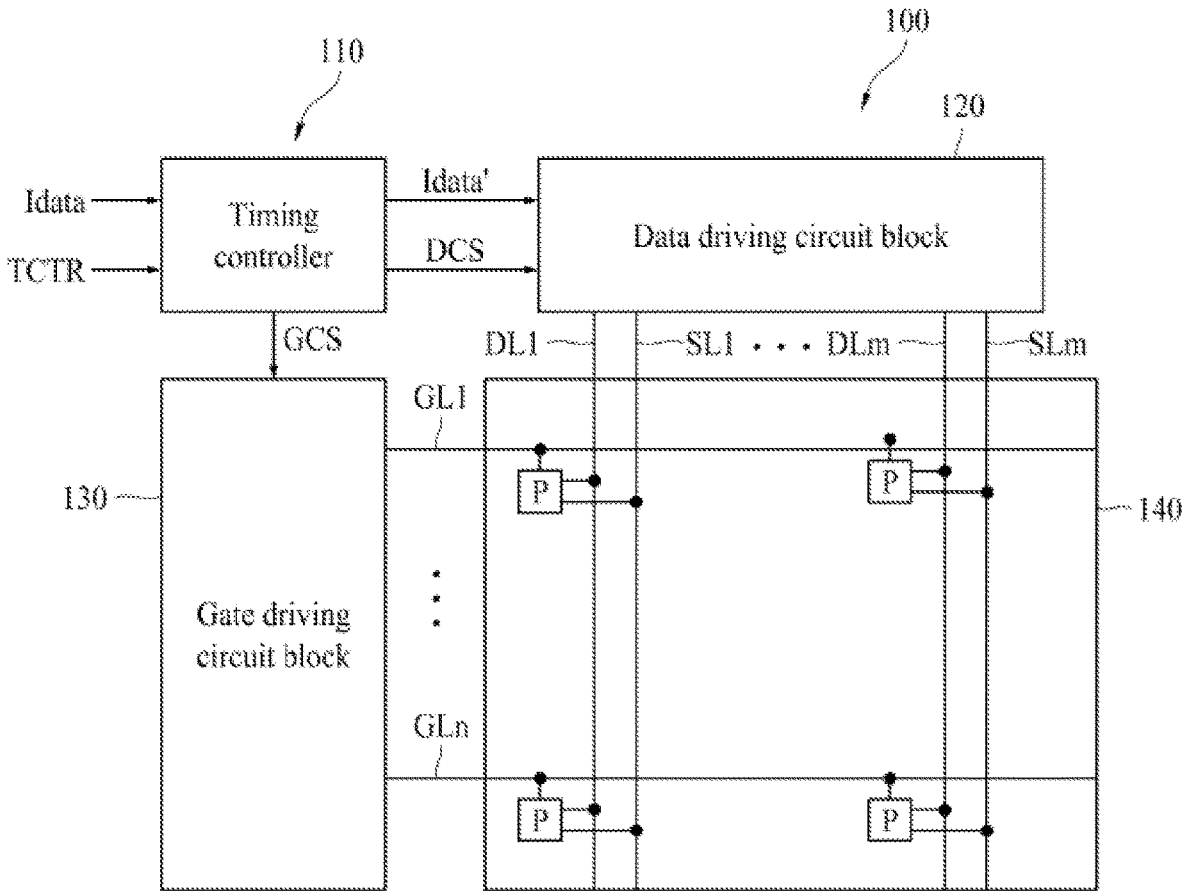
FIG. 1 is a block diagram of a display device including a timing controller and source driver integrated circuits (ICs) according to one embodiment of the present disclosure.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present specification will be described in detail with reference to the accompanying drawings.

FIG. 1 is a block diagram of a display device including a timing controller and source driver integrated circuits (ICs) according to one embodiment of the present disclosure. Referring to FIG. 1, a display device 100 includes a timing controller 110, a data driving circuit block 120, a gate driving circuit block 130, and an organic light-emitting diode (OLED) display panel 140.

The display device 100 may be a display device that includes pixels including OLEDs. For example, the display device 100 may be a display device for a television (TV) or a rollable display device.

The timing controller 110 generates first control signals DCS for controlling operations of the data driving circuit block 120 and second control signals GCS for controlling operations of the gate driving circuit block 130 using timing control signals TCTR. For example, the timing control signals TCTR may include a vertical synchronization signal Vsync, a horizontal synchronization signal Hsync, a dot clock signal, a data enable signal, and the like.

Further, the timing controller 110 converts image data Idata received from a host system (not shown) into digital video data Idata' in a form that can be processed by the data driving circuit block 120 and transmits the digital video data Idata' to the data driving circuit block 120.

The data driving circuit block 120 includes data driving ICs (or source driver ICs) to be described herein. During normal driving (or a normal operation), the data driving circuit block 120 converts the digital video data Idata' into data voltages for image display using the first control signals DCS and supplies the data voltages for image display to pixels P through data lines DL1 to DLm (where m is a natural number greater than or equal to two).

During the normal driving, the gate driving circuit block 130 generates gate pulses for image display using the second control signals GCS and sequentially supplies the gate pulses for image display to the pixels P through gate lines GL1 to GLn (where n is a natural number greater than or equal to two) in a row sequential manner.

During sensing driving (or a sensing operation), the data driving circuit block 120 generates data voltages for sensing using the first control signals DCS and supplies the data voltages for sensing to the pixels P through the data lines DL1 to DLm.

During the sensing driving, the gate driving circuit block 130 generates gate pulses for sensing using the second control signals GCS and sequentially supplies the gate pulses for sensing to the pixels P through the gate lines GL1 to GLn in a row sequential manner.

The display panel 140 includes the pixels P arranged in the form of an m×n matrix, and a corresponding pixel among the pixels P is connected to a corresponding data line among the data lines DL1 to DLm, a corresponding sensing line among sensing lines SL1 to SLm, and a corresponding gate line among the gate lines GL1 to GLn. The pixels P are respectively connected to the data lines DL1 to DLm in response to the gate pulses respectively input through the gate lines GL1 to GLn to receive the data voltages, and transmit sensing signals to the data driving circuit block 120 respectively through the sensing lines SL1 to SLm. Each pixel P includes an OLED.

Figure 2:
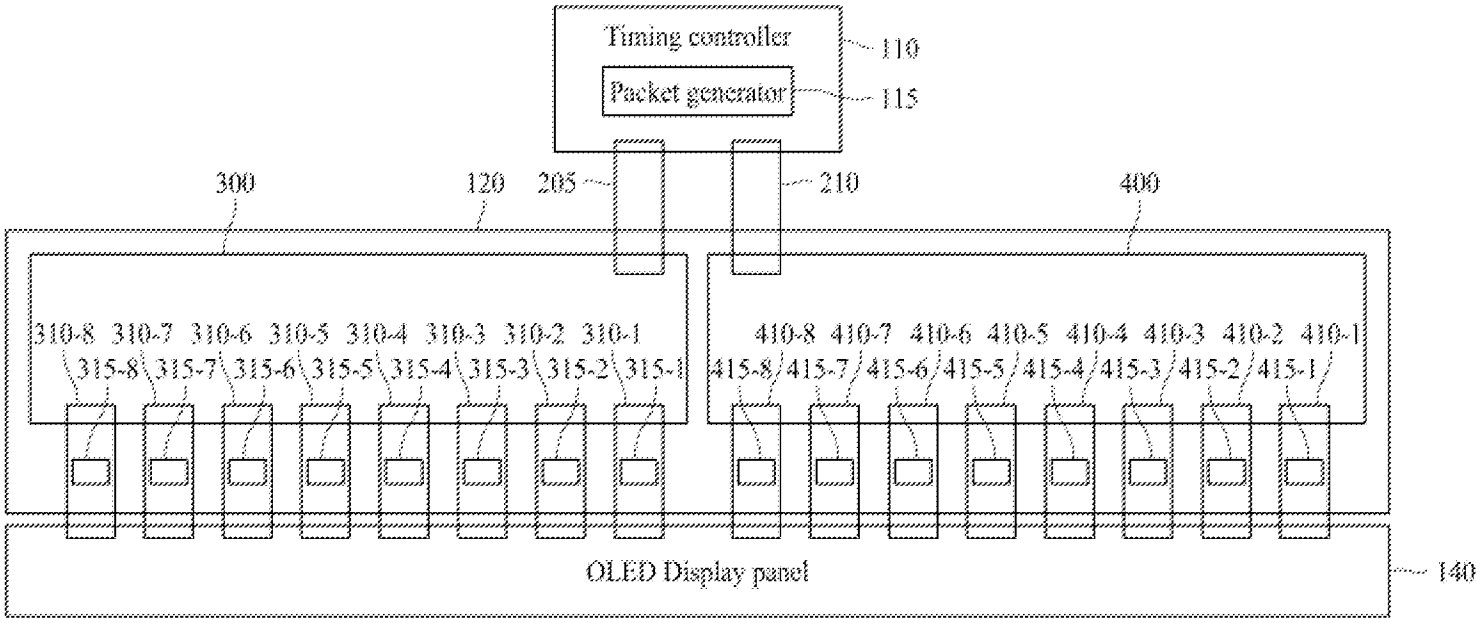
FIG. 2 is a diagram for describing a connection structure between the timing controller and the source driver ICs shown in FIG. 1.

FIG. 2 is a diagram for describing a connection structure between the timing controller and the source driver ICs shown in FIG. 1. Referring to FIGS. 1 and 2, the timing controller 110 may transmit and receive signals (or data) to and from the data driving circuit block 120 through cables 205 and 210. Although only two cables 205 and 210 are shown in FIG. 2, the number of cables connected between the timing controller 110 and the data driving circuit block 120 may be determined according to the number of boards 300 and 400 or the number of wires (or electric wires) formed on each of the boards 300 and 400.

The data driving circuit block 120 includes a first board 300, a first group of source driver ICs 315-1 to 315-8, a second board 400, and a second group of source driver ICs 415-1 to 415-8. Although the data driving circuit block 120 is shown in FIG. 2 as including eight source driver ICs for each of the boards 300 and 400 for convenience of description, this is just one example, and the number of the source driver ICs to be included in each of the boards 300 and 400 may vary.

In one embodiment, the first group of source driver ICs 315-1 to 315-8 may be connected to each other in a cascade manner, and the second group of source driver ICs 415-1 to 415-8 may be connected to each other in a cascade manner.

Each of the boards 300 and 400 may be implemented as a printed circuit board (PCB) or a flexible PCB (FPCB), but the present disclosure is not limited thereto. Wires (or electric wires) are additionally formed on each of the boards 300 and 400 to connect corresponding two source driver ICs in a point-to-point manner or a cascade manner.

The first group of source driver ICs 315-1 to 315-8 may transmit and receive signals (or data) to and from the timing controller 110 through the first board 300 and the cable 205, and the second group of source driver ICs 415-1 to 415-8 may transmit and receive signals (or data) to and from the timing controller 110 through the second board 400 and the cable 210.

The first group of source driver ICs 315-1 to 315-8 may be implemented as chip-on-films (COFs) 310-1 to 310-8, respectively, and the second group of source driver ICs 415-1 to 415-8 may be implemented as COFs 410-1 to 410-8, respectively.

The source driver ICs 315-1 to 315-8 and 415-1 to 415-8 are connected to the pixels included in the display panel 140 through the data lines DL1 to DLm and the sensing lines SL1 to SLm, respectively.

Figure 3:
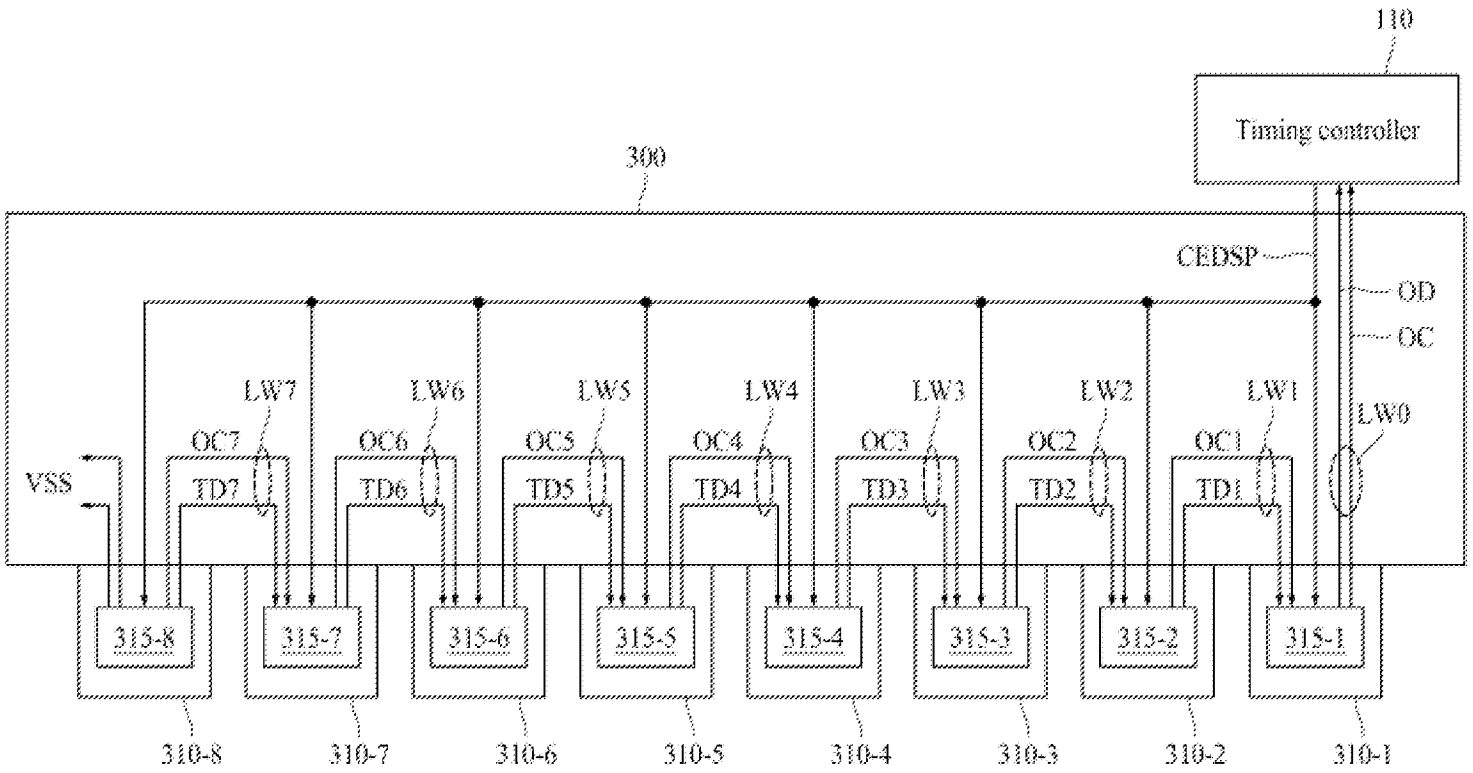
FIG. 3 is a diagram of an embodiment for describing a connection structure between the timing controller and a first group of source driver ICs shown in FIG. 2.
Figure 6:
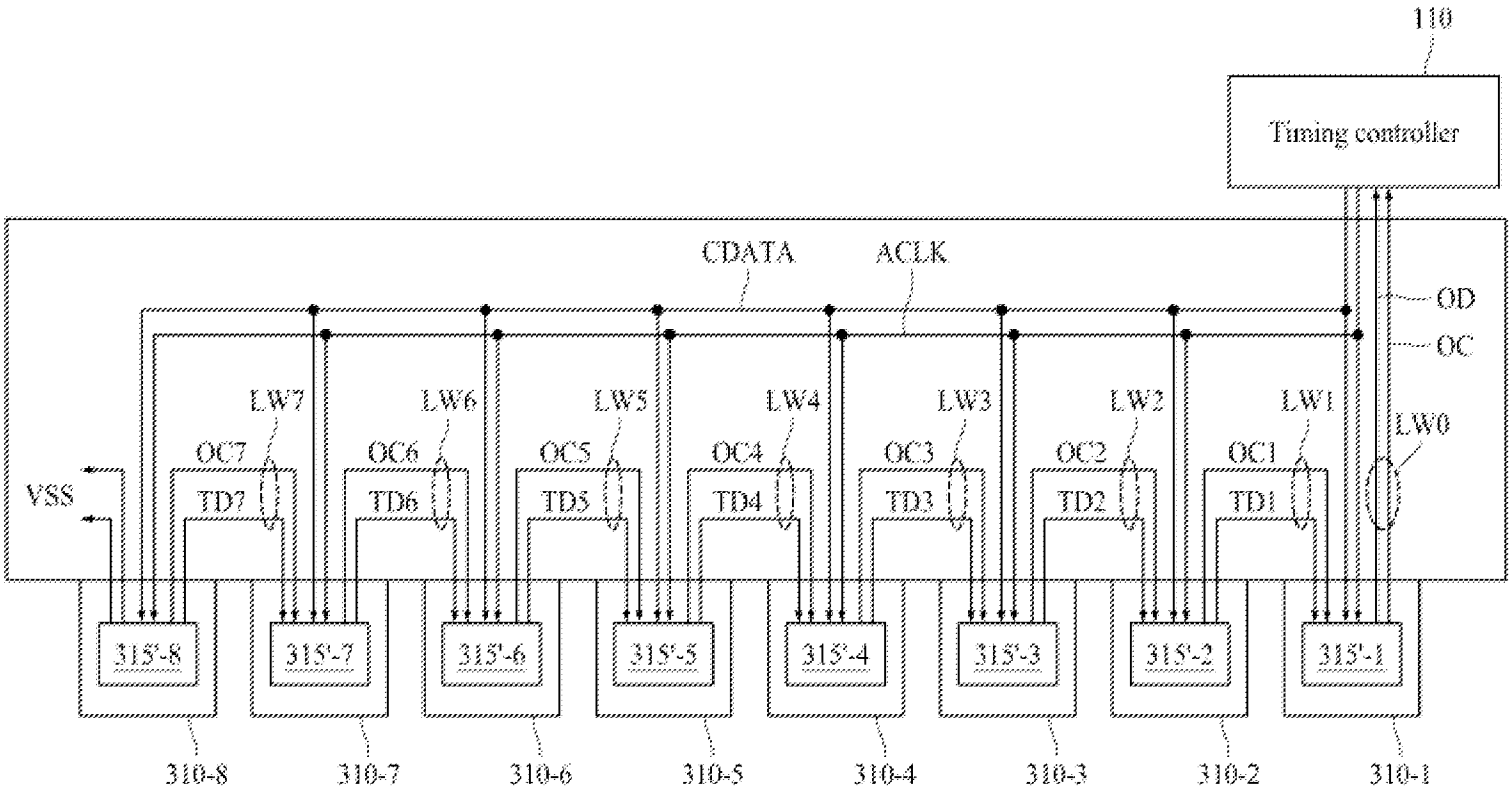
FIG. 6 is a diagram of another embodiment for describing a connection structure between the timing controller and the first group of source driver ICs shown in FIG. 2.

FIG. 3 is a diagram of an embodiment for describing a connection structure between the timing controller and the first group of source driver ICs shown in FIG. 2, and FIG. 6 is a diagram of another embodiment for describing a connection structure between the timing controller and the first group of source driver ICs shown in FIG. 2.

Referring to FIGS. 3 and 6, in order to receive a data packet CEDSP or CDATA output from the timing controller 110, each of the source driver ICs 315-1 to 315-8 or 315'-1 to 315'-8 (may be collectively expressed as 315-1 to 315-8) is connected to the timing controller 110 in a point-to-point manner through the board 300, the source driver ICs 315-1 to 315-8 are connected to each other in a cascade manner to transmit transmission sensing data TDi (where 1<=i<=7) and a transmission clock signal OCi, and among the source driver ICs 315-1 to 315-8, an output source driver IC, which outputs output sensing data OD and an output clock signal OC to the timing controller 110, for example, a first source driver IC 315-1 and the timing controller 110 are connected in a point-to-point manner.

Referring to FIGS. 1 to 3, it is assumed that the timing controller 110 controls the first group of source driver ICs 315-1 to 315-8 and the second group of source driver ICs 415-1 to 415-8 using the clock embedded data signaling (CEDS) protocol.

It is assumed that operations between the timing controller 110 and the second group of source driver ICs 415-1 to 415-8 are the same as operations between the timing controller 110 and the first group of source driver ICs 315-1 to 315-8. Thus, hereinafter, for convenience of description, only the operations between the timing controller 110 and the first group of source driver ICs 315-1 to 315-8 will be described.

The transmission clock signal OCi is a clock signal used for transmission of the transmission sensing data TDi, and the output clock signal OC is a clock signal used for transmission of the output sensing data OD. Each transmission clock signal OCi and each piece of transmission sensing data TDi are transmitted together (or by being synchronized), and the output clock signal OC and the output sensing data OD are transmitted together (or by being synchronized).

The source driver ICs 315-2 to 315-7, except for the first source driver IC 315-1 and the last source driver IC 315-8, transmit self-sensing data to the next source driver ICs 315-1 to 315-6, respectively, or transmit transmission sensing data output from the previous source driver ICs 315-3 to 315-8 to the next source driver ICs 315-1 to 315-6, respectively, according to commands (or operation instruction signals) included in a CEDS control packet CEDSP.

Here, the self-sensing data refers to the sensing data generated by the source driver IC itself, and the transmission sensing data refers to the sensing data transmitted from the other source driver ICs. In addition, the commands (or operation instruction signals) included in the CEDS control packet CEDSP are generated by a packet generator 115 included in the timing controller 110 and indicate whether the operation to be performed in each of the source driver ICs 315-1 to 315-8 is a sensing operation or a transmission operation.

For example, when reference is made to a second source driver IC 315-2, the next source driver IC is the first source driver IC 315-1, and the previous source driver IC is a third source driver IC 315-3. Further, when reference is made to a seventh source driver IC 315-7, the next source driver IC is a sixth source driver IC 315-6, and the previous source driver IC is an eighth source driver IC 315-8.

The first source driver IC 315-1 outputs self-sensing data SD1 generated (or sensed) by the first source driver IC 315-1 to the timing controller 110 as the output sensing data OD or outputs transmission sensing data TD1 output from the second source driver IC 315-2 to the timing controller 110 as the output sensing data OD according to the commands included in the CEDS control packet CEDSP. In this case, the first source driver IC 315-1 may transmit the output clock signal OC to the timing controller 110 together with the output sensing data OD.

The last source driver IC 315-8 outputs self-sensing data SD8 generated (or sensed) by the last source driver IC 315-8 to the seventh source driver IC 315-7 as transmission sensing data TD7 or outputs dummy data (e.g., all-zero data) with a specific pattern, which indicates that there is no output since the previous source driver IC does not exist, to the seventh source driver IC 315-7 as the transmission sensing data TD7 according to the commands included in the CEDS control packet CEDSP. In this case, the last source driver IC 315-8 outputs a transmission clock signal OC7 to the seventh source driver IC 315-7 together with the transmission sensing data TD7.

Figure 4:
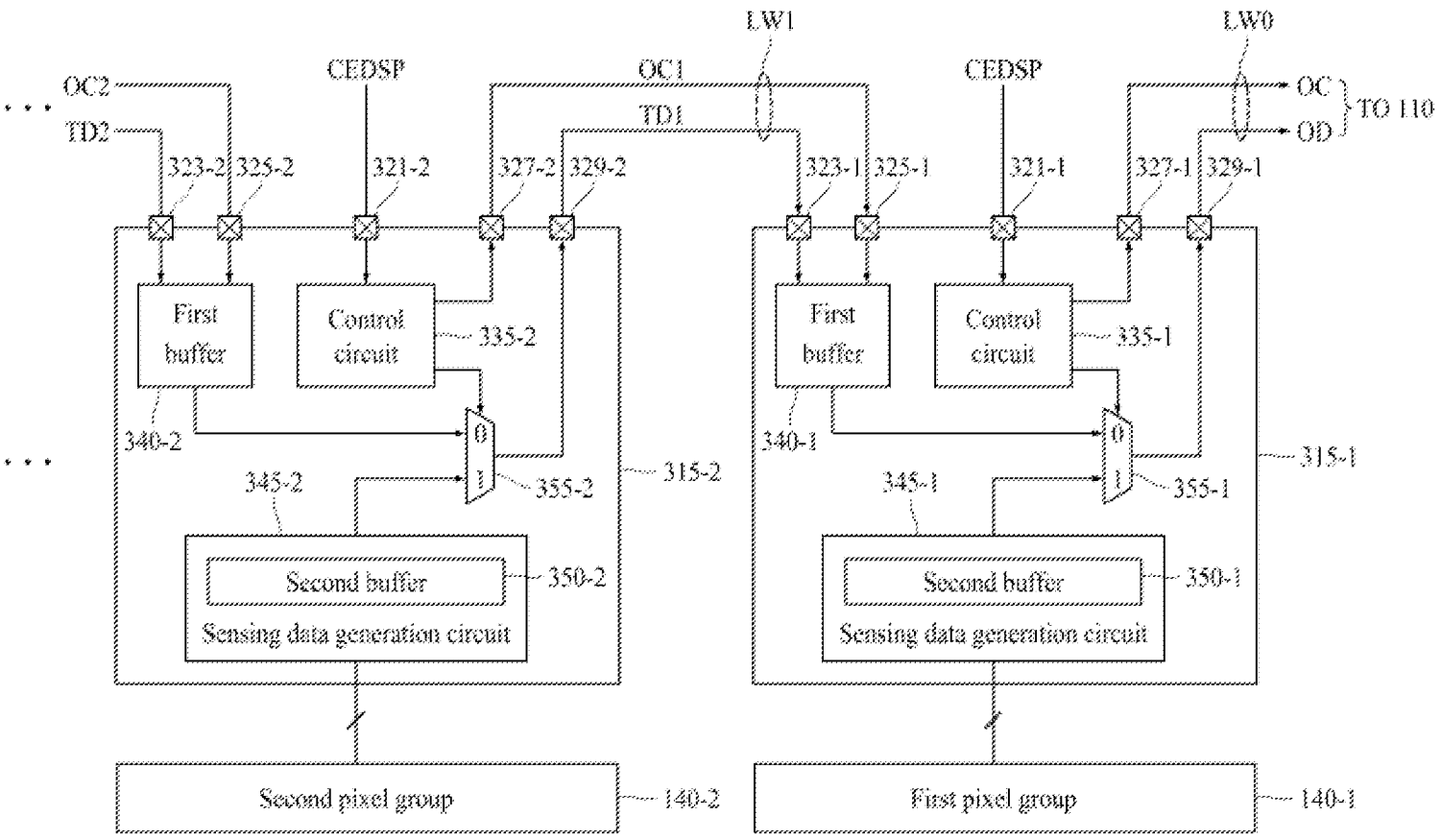
FIG. 4 is a block diagram illustrating the source driver ICs shown in FIG. 3.

Referring to FIGS. 3 and 4, when the source driver IC having the same configuration as the first source driver IC 315-1 is used as the last source driver IC 315-8, data pins 323-1 and 325-1 may be grounded. Thus, all-zero data may be stored in a first buffer of the last source driver IC 315-8.

On the first board 300, wires LW1 to LW7 for transmitting the transmission sensing data TDi (1<=i<=7) and the transmission clock signal OCi output from one of two adjacent source driver ICs to the other one of the two source driver ICs are formed, and an output wire LW0 for transmitting the output sensing data OD and the output clock signal OC output from the first source driver IC 315-1 to the timing controller 110 is formed. The number of electric wires included in each of the wires LW0 to LW7 may be determined according to the number of transmitted signals.

On the second board 400, wires for transmitting transmission sensing data and a transmission clock signal output from one of two adjacent source driver ICs to the other one of the two source driver ICs are also formed, and a wire for transmitting output sensing data and an output clock signal output from an eighth source driver IC 415-8 to the timing controller 110 is also formed.

Each signal CEDSP, TDi, OCi, OD, OC, CDATA, or ACLK described herein refers to a single signal or differential signals. Thus, when each signal CEDSP, TDi, OCi, OD, OC, CDATA, or ACLK has differential signals, the wires (or electric wires) that transmit the differential signals are formed (or disposed) in a pair.

FIG. 4 is a block diagram illustrating the source driver ICs shown in FIG. 3. Referring to FIGS. 1 to 4, since it is assumed that the structure and function of each of the source driver ICs 315-1 to 315-8 and 415-1 to 415-8 are the same, the structure and operation of each of two source driver ICs 315-1 and 315-2 will be described in detail with reference to FIG. 4.

The first source driver IC 315-1 includes a pin 321-1 configured to receive the CEDS control packet CEDSP, a pin 323-1 configured to receive the input transmission sensing data TD1, a pin 325-1 configured to receive the input transmission clock signal OC1, a pin 327-1 configured to output the output clock signal OC, and a pin 329-1 configured to output the output sensing data OD.

The second source driver IC 315-2 includes a pin 321-2 configured to receive the CEDS control packet CEDSP, a pin 323-2 configured to receive the input transmission sensing data TD2, a pin 325-2 configured to receive the input transmission clock signal OC2, a pin 327-2 configured to output the transmission clock signal OC1, and a pin 329-2 configured to output the transmission sensing data TD1.

The number of each pin 321-*k*, 323-*k*, 325-*k*, 327-*k*, or 329-*k* (where k is one or two) may be designed to be suitable for the characteristics of input and output signals (e.g., differential signals, serial data, or parallel data). Thus, each pin 321-*k*, 323-*k*, 325-*k*, 327-*k*, or 329-*k* may refer to one or two or more pins. Each pin 321-*k*, 323-*k*, 325-*k*, 327-*k*, or 329-*k* may be a port or a pad.

The first source driver IC 315-1 may include a control circuit 335-1, a first buffer 340-1, a sensing data generation circuit 345-1 including a second buffer 350-1, and a selector 355-1. The second source driver IC 315-2 may include a control circuit 335-2, a first buffer 340-2, a sensing data generation circuit 345-2 including a second buffer 350-2, and a selector 355-2. The second buffer 350-1 or 350-2 may be implemented outside each sensing data generation circuit 345-1 or 345-2. Each buffer 340-1, 340-2, 350-1, or 350-2 may be implemented as a latch or a register.

When the CEDS control packet CEDSP is a packet in which a clock signal and a control data signal are embedded between data signals, each control circuit 335-1 or 335-2 may extract the clock signal and a command from the CEDS control packet CEDSP.

For example, the control circuit 335-2 outputs the transmission clock signal OC1 corresponding to the clock signal, which is included in the CEDS control packet CEDSP input to the second source driver IC 315-2, to the pin 325-1 of the first source driver IC 315-1 through the pin 327-2 and the wire LW1, and the control circuit 335-1 outputs the output clock signal OC corresponding to the clock signal, which is included in the CEDS control packet CEDSP input to the first source driver IC 315-1, to the timing controller 110 through the pin 327-1 and the wire LW0. Thus, since the timing controller 110 receives the output clock signal OC from the first source driver IC 315-1 that is closest to the timing controller 110, the timing controller 110 is allowed to receive the output clock signal OC having hardly any skew as compared to the clock signal included in the CEDS control packet CEDSP.

The control circuit 335-2 controls an operation of storing the transmission sensing data TD2 transmitted from the third source driver IC 315-3 in the first buffer 340-2, an operation of transmitting the transmission sensing data TD2 stored in the first buffer 340-2 to the pin 329-2 through the selector 355-2, an operation of transmitting the transmission clock signal OC1 to the first source driver IC 315-1, an operation of transmitting self-sensing data SD2 stored in the second buffer 350-2 to the pin 329-2 through the selector 355-2, and/or an operation of the sensing data generation circuit 345-2 to perform an operation of generating the self-sensing data SD2.

The first buffer 340-2 receives and stores the transmission sensing data TD2 transmitted from the third source driver IC 315-3.

The sensing data generation circuit 345-2 generates the self-sensing data SD2 on the basis of sensing signals output from the pixels included in a second pixel group 140-2 and stores the self-sensing data SD2 in the second buffer 350-2. In one embodiment, the sensing signals may include threshold voltage or mobility of a driving element (e.g., a driving transistor) included in each pixel. Since a method of generating the self-sensing data SD2 by the sensing data generation circuit 345-2 is a known technique, a detailed description thereof will be omitted.

The control circuit 335-2 generates a selection signal SEL on the basis of the command included in the CEDS control packet CEDSP.

In one embodiment, when the selection signal SEL has a first level (e.g., a low level or data "zero"), the selector 355-2 outputs the transmission sensing data TD2 stored in the first buffer 340-2 to the pin 329-2. When the selection signal SEL has a second level (e.g., a high level or data "one"), the selector 355-2 outputs the self-sensing data SD2 stored in the second buffer 350-2 to the pin 329-2.

The control circuit 335-1 controls an operation of storing the transmission sensing data TD1 transmitted from the second source driver IC 315-2 in the first buffer 340-1, an operation of transmitting the transmission sensing data TD1 stored in the first buffer 340-1 to the pin 329-1 through the selector 355-1, an operation of transmitting the output clock signal OC to the timing controller 110, an operation of transmitting the self-sensing data SD1 stored in the second buffer 350-1 to the pin 329-1 through the selector 355-1, and/or an operation of the sensing data generation circuit 345-1 to perform an operation of generating the self-sensing data SD1.

The first buffer 340-1 receives and stores the transmission sensing data TD1 transmitted from the second source driver IC 315-2.

The sensing data generation circuit 345-1 generates the self-sensing data SD1 on the basis of sensing signals output from the pixels included in a first pixel group 140-1 and stores the self-sensing data SD1 in the second buffer 350-1.

The control circuit 335-1 generates a selection signal SEL on the basis of the command included in the CEDS control packet CEDSP.

When the selection signal SEL has the first level, the selector 355-1 outputs the transmission sensing data TD1 stored in the first buffer 340-1 to the pin 329-1. When the selection signal SEL has the second level, the selector 355-1 outputs the self-sensing data SD1 stored in the second buffer 350-1 to the pin 329-1.

Since the structure and operation of each of the source driver ICs 315-3 to 315-8 are the same as those of the first source driver IC 315-1 or the structure and operation of the second source driver IC 315-2, a description of the operation of each of the source driver ICs 315-3 to 315-8 will be omitted.

Figure 5:
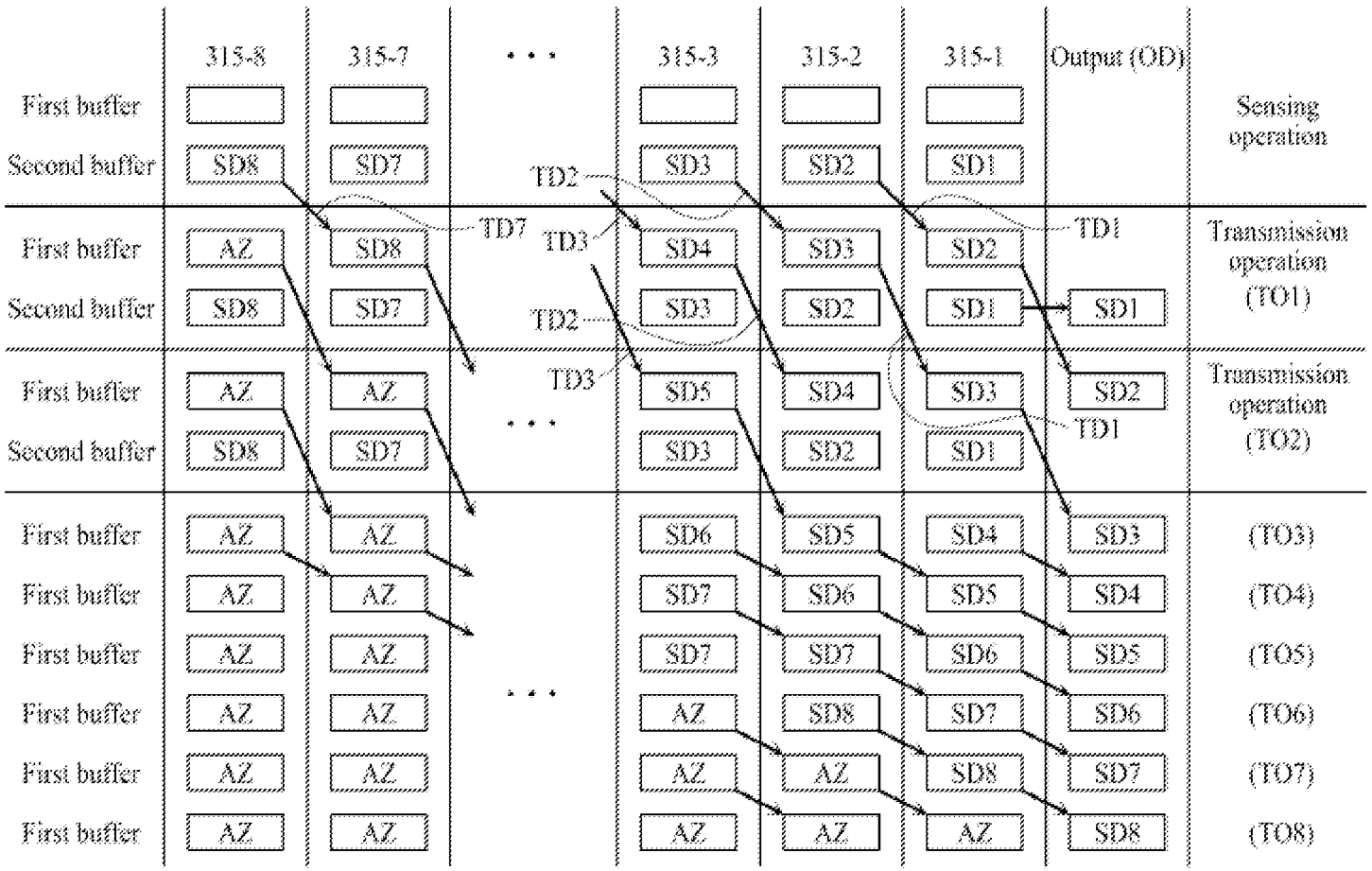
FIG. 5 is a diagram for describing sensing data transmission operations of the first group of source driver ICs shown in FIG. 3.

FIG. 5 is a diagram for describing sensing data transmission operations of the first group of source driver ICs shown in FIG. 3.

Referring to FIGS. 1 to 5, for the sensing operation, the packet generator 115 of the timing controller 110 generates the CEDS control packet CEDSP including a command (e.g., a sensing command) instructing the performance of the sensing operation, and transmits the CEDS control packet CEDSP to each of the source driver ICs 315-1 to 315-8.

The control circuit of each of the source driver ICs 315-1 to 315-8 generates control signals corresponding to the sensing command included in the CEDS control packet CEDSP. The sensing data generation circuit of each of the source driver ICs 315-1 to 315-8 receives sensing signals from the pixels included in each pixel group connected (or allocated) to each of the source driver ICs 315-1 to 315-8 in response to the control signals, generates sensing data (e.g., self-sensing data) corresponding to the sensing signals, and stores the self-sensing data in the second buffer of each of the source driver ICs 315-1 to 315-8.

For example, the second buffers of the source driver ICs 315-1 to 315-8 respectively store the self-sensing data SD1 to SD8.

The packet generator 115 of the timing controller 110 generates the CEDS control packet CEDSP including a command (e.g., a transmission command) instructing the transmission operation and transmits the CEDS control packet CEDSP to each of the source driver ICs 315-1 to 315-8.

In a first transmission operation TO1, the control circuit of each of the source driver ICs 315-1 to 315-8 generates the selection signal having the second level on the basis of the transmission command included in the CEDS control packet CEDSP, and thus the selectors of the source driver ICs 315-1 to 315-8 respectively output the self-sensing data SD1 to SD8, which are respectively stored in the second buffers of the source driver ICs 315-1 to 315-8, to the other devices (the timing controller 110 and the source driver ICs 315-1 to 315-7).

In the first transmission operation TO1, the first source driver IC 315-1 transmits the self-sensing data SD1 stored in the second buffer 350-1 of the first source driver IC 315-1 to the timing controller 110 as the output sensing data OD, and the source driver ICs 315-2 to 315-8 respectively transmit self-sensing data SD2 to SD8, which is respectively stored in the second buffers thereof, to the adjacent source driver ICs 315-1 to 315-7. Accordingly, the adjacent source driver ICs 315-1 to 315-7 respectively store the transmission sensing data TD1=SD2, TD2=SD3, TD3=SD4, TD4=SD5, TD5=SD6, TD6=SD7, and TD7=SD8, which is respectively output from the second buffers of the source driver ICs 315-2 to 315-8, in the first buffers thereof. Since the pins (pins corresponding to the pin 323-1 and the pin 325-1) of the last source driver IC 315-8 are grounded, all-zero data AZ may be stored in the first buffer of the last source driver IC 315-8.

In a second transmission operation TO2, the control circuit of each of the source driver ICs 315-1 to 315-8 generates the selection signal having the first level on the basis of the transmission command included in the CEDS control packet CEDSP, and thus the selectors of the source driver ICs 315-1 to 315-8 respectively output the sensing data SD2 to SD7 and AZ, which is respectively stored in the first buffers of the source driver ICs 315-1 to 315-8, to the other devices (the timing controller 110 and the source driver ICs 315-1 to 315-7).

In the second transmission operation TO2, the first source driver IC 315-1 transmits the sensing data SD2 stored in the first buffer 340-1 of the first source driver IC 315-1 to the timing controller 110 as the output sensing data OD, and the source driver ICs 315-2 to 315-8 respectively transmit sensing data TD1=SD3, TD2=SD4, TD3=SD5, TD4=SD6, TD5=SD7, TD6=SD8, and TD7=AZ, which is respectively stored in the first buffers thereof, to the adjacent source driver ICs 315-1 to 315-7. Accordingly, the adjacent source driver ICs 315-1 to 315-7 respectively store the sensing data TD1=SD3, TD2=SD4, TD3=SD5, TD4=SD6, TD5=SD7, TD6=SD8, and TD7=AZ, which is respectively output from the first buffers of the source driver ICs 315-2 to 315-8, in the first buffers thereof.

In a third transmission operation TO3, the first source driver IC 315-1 transmits the sensing data SD3 stored in the first buffer 340-1 of the first source driver IC 315-1 to the timing controller 110 as the output sensing data OD, and the source driver ICs 315-2 to 315-8 respectively transmit sensing data, which is respectively stored in the first buffers thereof, to the adjacent source driver ICs 315-1 to 315-7. Accordingly, the adjacent source driver ICs 315-1 to 315-7 respectively store the sensing data TD1=SD4, TD2=SD5, TD3=SD6, TD4=SD7, TD5=SD8, TD6=AZ, and TD7=AZ, which is respectively output from the first buffers of the source driver ICs 315-2 to 315-8, in the first buffers thereof.

In a fourth transmission operation TO4, the first source driver IC 315-1 receives the self-sensing data SD4 generated by a fourth source driver IC 315-4 and transmits the self-sensing data SD4 to the timing controller 110 as the output sensing data OD through the transmission sensing data shift operation performed between the source driver ICs in a point-to-point (or cascade) manner as described above. In a fifth transmission operation TO5, the first source driver IC 315-1 receives the self-sensing data SD5 generated by a fifth source driver IC 315-5 and transmits the self-sensing data SD5 to the timing controller 110 as the output sensing data OD, and in a sixth transmission operation TO6, the first source driver IC 315-1 receives the self-sensing data SD6 generated by the sixth source driver IC 315-6 and transmits the self-sensing data SD6 to the timing controller 110 as the output sensing data OD. In a seventh transmission operation TO7, the first source driver IC 315-1 receives the self-sensing data SD7 generated by the seventh source driver IC 315-7 and transmits the self-sensing data SD7 to the timing controller 110 as the output sensing data OD, and in an eighth transmission operation TO8, the first source driver IC 315-1 receives the self-sensing data SD8 generated by the eighth source driver IC 315-8 and transmits the self-sensing data SD8 to the timing controller 110 as the output sensing data OD.

As described with reference to FIGS. 1 to 5, the eighth sensing data (SD8=TD7) generated by the eighth source driver IC 315-8 is transmitted to the seventh source driver IC 315-7 through a seventh wire LW7 by the first transmission operation TO1, the eighth sensing data (SD8=TD6) transmitted to the seventh source driver IC 315-7 is transmitted to the sixth source driver IC 315-6 through a sixth wire LW6 by the second transmission operation TO2, the eighth sensing data (SD8=TD5) transmitted to the sixth source driver IC 315-6 is transmitted to the fifth source driver IC 315-5 through a fifth wire LW5 by the third transmission operation TO3, the eighth sensing data (SD8=TD4) transmitted to the fifth source driver IC 315-5 is transmitted to the fourth source driver IC 315-4 through a fourth wire LW4 by the fourth transmission operation TO4, the eighth sensing data (SD8=TD3) transmitted to the fourth source driver IC 315-4 is transmitted to the third source driver IC 315-3 through a third wire LW3 by the fifth transmission operation TO5, the eighth sensing data (SD8=TD2) transmitted to the third source driver IC 315-3 is transmitted to the second source driver IC 315-2 through a second wire LW2 by the sixth transmission operation TO6, the eighth sensing data (SD8=TD1) transmitted to the second source driver IC 315-2 is transmitted to the first source driver IC 315-1 through a first wire LW1 by the seventh transmission operation TO7, and the eighth sensing data (SD8=OD) transmitted to the first source driver IC 315-1 is transmitted to the timing controller 110 through the output wire LW0 by the eighth transmission operation TO8.

Since the process in which each piece of sensing data SD1, SD2, SD3, SD4, SD5, SD6, or SD7 is transmitted to the first source driver IC 315-1 by one or two or more transmission operations and then transmitted to the timing controller 110 through the output wire LW0 is similar to the process in which the eighth sensing data SD8 is transmitted to the first source driver IC 315-1 through other source driver ICs 315-2 to 315-7 and then transmitted to the timing controller 110 through the output wire LW0, detailed descriptions thereof will be omitted.

Through the above-described processes, the first source driver IC 315-1 sequentially transmits all the sensing data SD1 to SD8 to the timing controller 110 through the output wire LW0.

Meanwhile, when the output sensing data OD is transmitted to the timing controller 110, the timing controller 110 may be considered as a slave device (or in a slave state) and each of the source driver ICs 315-1 to 315-8 may be considered as a master device (or in a master state). In this case, since there are eight master devices, among the source driver ICs 315-1 to 315-8, at least one source driver IC that does not transmit the sensing data should indicate that it does not output the sensing data.

In one embodiment, among the source driver ICs 315-1 to 315-8, the source driver IC that does not transmit the sensing data may clear the first buffer **340-*i* and the second buffer 350-*i* thereof or make the selector 355-*i*** to output a predetermined level of value (e.g., "0") to indicate that the source driver IC does not output the sense data.

As described above, according to the present disclosure, since the timing controller 110 receives the sensing data and the clock signal of each of the source driver ICs 315-1 to 315-8 through only the first source driver IC 315-1 among the source driver ICs 315-1 to 315-8, a separate tuning operation for matching phases of the clock signals is not required to be performed, unlike the conventional timing controller which receives sensing data and clock signals from each of source driver ICs and thus is required to perform a tuning operation to match phases of the clock signals of the source driver ICs so that logic design of the timing controller 110 is simplified.

FIG. 6 is a diagram of another embodiment for describing the connection structure between the timing controller and the first group of source driver ICs shown in FIG. 2.

Referring to FIGS. 1, 2, and 6, it is assumed that the timing controller 110 controls a first group of source driver ICs 315'-1 to 315'-8 and a second group of source driver ICs (that is, they are arranged in the same manner as the second group of source driver ICs 415-1 to 415-8 shown in FIG. 2) using a data packet CDATA and a reference clock signal ACLK.

The operation of each of the source driver ICs 315'-1 to 315'-8 in the first group is similar to the operation of each of the source driver ICs 315'-1 to 315'-8 in the second group, and thus a description of the operation of each of the source driver ICs in the second group will be omitted.

When the data packet CDATA is not a data packet conforming to the CEDS protocol, the reference clock signal ACLK is required for transmission of the data packet CDATA. The reference clock signal ACLK refers to a clock signal used when the timing controller 110 transmits the data packet CDATA, and an output clock signal OC refers to a clock signal used when transmitting output sensing data OD.

For convenience of description, the operations of the timing controller 110 and the first group of source driver ICs 315'-1 to 315'-8 will be described with reference to FIGS. 6 and 7. It is assumed that the operations of the timing controller 110 and the second group of source driver ICs (source driver ICs having the same arrangement as the source driver ICs 415-1 to 415-8 of FIG. 2) are the same as those of the timing controller 110 and the first group of source driver ICs 315'-1 to 315'-8.

The source driver ICs 315'-2 to 315'-7, except for a first source driver IC 315'-1 and the last source driver IC 315'-8, transmit self-sensing data to the next source driver ICs 315'-1 to 315'-6, respectively, or transmit transmission sensing data output from the previous source driver ICs 315'-3 to 315'-8 to the next source driver ICs 315'-1 to 315'-6, respectively, according to commands included in the data packet CDATA. As described above, a command instructing the performance of a sensing operation or a transmission operation may be generated by the packet generator 115 included in the timing controller 110.

For example, when reference is made to a second source driver IC 315'-2, the next source driver IC is the first source driver IC 315'-1, and the previous source driver IC is a third source driver IC 315'-3.

The first source driver IC 315'-1 outputs self-sensing data generated (or sensed) by the first source driver IC 315'-1 to the timing controller 110 as the output sensing data OD or outputs transmission sensing data TD1 transmitted from the second source driver IC 315'-2 to the timing controller 110 as the output sensing data OD according to the commands included in the data packet CDATA. In this case, the first source driver IC 315'-1 may transmit the output clock signal OC to the timing controller 110 together with the output sensing data OD.

The last source driver IC 315'-8 outputs self-sensing data SD8 generated (or sensed) by the last source driver IC 315'-8 to the seventh source driver IC 315'-7 as transmission sensing data TD7 or outputs data with a specific pattern (e.g., all zero), since the previous source driver IC does not exist, to a seventh source driver IC 315'-7 as the transmission sensing data TD7 according to the commands included in data packet CDATA. In this case, the last source driver IC 315'-8 outputs a transmission clock signal OC7 to the seventh source driver IC 315'-7 together with the transmission sensing data TD7.

Figure 7:
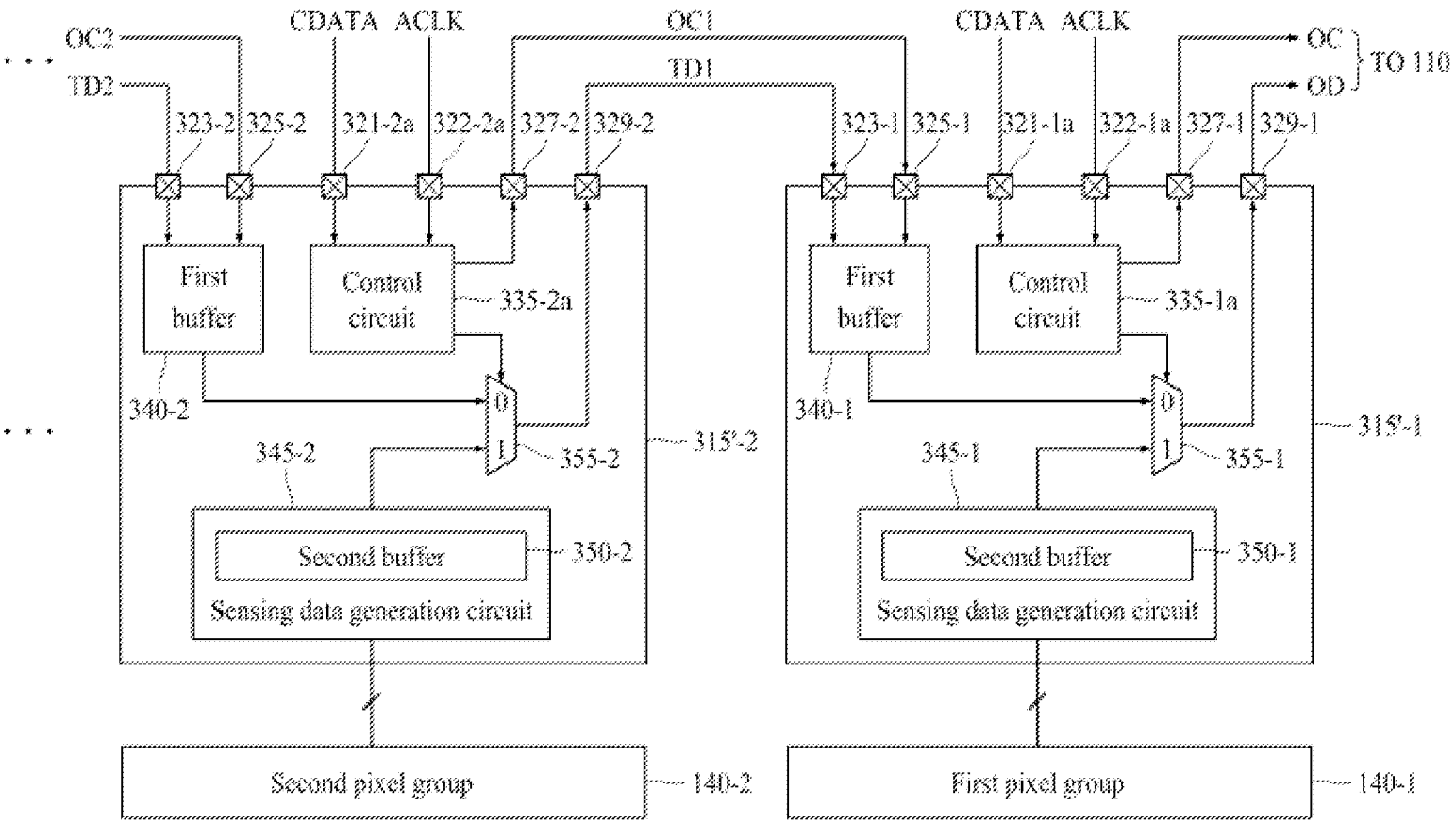
FIG. 7 is a block diagram of the source driver ICs shown in FIG. 6.

Referring to FIGS. 6 and 7, when the source driver IC having the same configuration as the first source driver IC 315'-1 is used as the last source driver IC 315'-8, pins 323-1 and 325-1 in FIG. 7 may be grounded.

FIG. 7 illustrates a block diagram of the source driver ICs shown in FIG. 6.

Referring to FIGS. 1, 2, 6, and 7, since it is assumed that the structure and function of each of the source driver ICs 315'-1 to 315'-8 are the same, the structure and operation of the two source driver ICs 315'-1 and 315'-2 will be described in detail.

The first source driver IC 315'-1 includes a pin 321-1*a* configured to receive the data packet CDATA including commands, a pin 322-1*a* configured to receive the reference clock signal ACLK, a pin 323-1 configured to receive the input transmission sensing data TD1, a pin 325-1 configured to receive an input transmission clock signal OC1, a pin 327-1 configured to output the output clock signal OC, and a pin 329-1 configured to output the output sensing data OD.

The second source driver IC 315'-2 includes a pin 321-2*a* configured to receive the data packet CDATA including commands, a pin 322-2*a* configured to receive the reference clock signal ACLK, a pin 323-2 configured to receive the input transmission sensing data TD2, a pin 325-2 configured to receive an input transmission clock signal OC2, a pin 327-2 configured to output the transmission clock signal OC1, and a pin 329-2 configured to output the transmission sensing data TD1.

The number of each pin 321-*ka*, 322-*ka*, 323-*k*, 325-*k*, 327-*k*, or 329-*k* (where k is one or two) may be designed to be suitable for the characteristics of the input and output signals (e.g., differential signals, serial data, or parallel data). Thus, each pin 321-*ka*, 322-*ka*, 323-*k*, 325-*k*, 327-*k*, or 329-*k* may refer to one or two or more pins. Each pin 321-*ka*, 322-*ka*, 323-*k*, 325-*k*, 327-*k*, or 329-*k* may be a port or a pad.

The first source driver IC 315'-1 may include a control circuit 335-1*a*, a first buffer 340-1, a sensing data generation circuit 345-1 including a second buffer 350-1, and a selector 355-1. The second source driver IC 315'-2 may include a control circuit 335-2*a*, a first buffer 340-2, a sensing data generation circuit 345-2 including a second buffer 350-2, and a selector 355-2.

The control circuit 335-1*a* may extract commands from the data packet CDATA and may determine the output clock signal OC using the reference clock signal ACLK. In addition, the control circuit 335-2*a* may extract commands from the data packet CDATA and may determine the transmission clock signal OC1 using the reference clock signal ACLK.

The control circuit 335-2*a* outputs the transmission clock signal OC1 to the pin 325-1 of the first source driver IC 315'-1 through the pin 327-2, and the control circuit 335-1*a* outputs the output clock signal OC to the timing controller 110 through the pin 327-1.

The control circuit 335-2*a* controls an operation of storing the transmission sensing data TD2 output from the third source driver IC 315'-3 in the first buffer 340-2, an operation of transmitting the transmission sensing data TD2 stored in the first buffer 340-2 to the pin 329-2 through the selector 355-2, an operation of transmitting the transmission clock signal OC1 to the first source driver IC 315'-1, an operation of transmitting self-sensing data SD2 stored in the second buffer 350-2 to the pin 329-2 through the selector 355-2, and/or an operation of the sensing data generation circuit 345-2 to perform an operation of generating the self-sensing data SD2.

The first buffer 340-2 receives and stores the transmission sensing data TD2 output from the third source driver IC 315'-3.

The sensing data generation circuit 345-2 generates the self-sensing data SD2 on the basis of sensing signals output from the pixels included in the second pixel group 140-2 and stores the self-sensing data SD2 in the second buffer 350-2.

The control circuit 335-2*a* generates a selection signal SEL on the basis of the command included in the data packet CDATA.

When the selection signal SEL has a first level, the selector 355-2 outputs the transmission sensing data TD2 stored in the first buffer 340-2 to the pin 329-2. When the selection signal SEL has a second level, the selector 355-2 outputs the self-sensing data SD2 stored in the second buffer 350-2 to the pin 329-2.

The control circuit 335-1*a* controls an operation of storing the transmission sensing data TD1 transmitted from the second source driver IC 315'-2 in the first buffer 340-1, an operation of transmitting the transmission sensing data TD1 stored in the first buffer 340-1 to the pin 329-1 through the selector 355-1, an operation of transmitting the output clock signal OC to the timing controller 110, an operation of transmitting the self-sensing data SD1 stored in the second buffer 350-1 to the pin 329-1 through the selector 355-1, and/or an operation of the sensing data generation circuit 345-1 to perform an operation of generating the self-sensing data SD1.

The first buffer 340-1 receives and stores the transmission sensing data TD1 transmitted from the second source driver IC 315'-2.

The sensing data generation circuit 345-1 generates the self-sensing data SD1 on the basis of sensing signals output from the pixels included in the first pixel group 140-1 and stores the self-sensing data SD1 in the second buffer 350-1.

The control circuit 335-1*a* generates a selection signal SEL on the basis of the command included in the data packet CDATA.

When the selection signal SEL has a first level, the selector 355-1 outputs the transmission sensing data TD1 stored in the first buffer 340-1 to the pin 329-1. When the selection signal SEL has a second level, the selector 355-1 outputs the self-sensing data SD1 stored in the second buffer 350-1 to the pin 329-1.

Since the structure and operation of each of the source driver ICs 315'-3 to 315'-8 are the same as those of the first source driver IC 315'-1 or the structure and operation of the second source driver IC 315'-2, a description of the operation of each of the source driver ICs 315'-3 to 315'-8 will be omitted.

Figure 8:
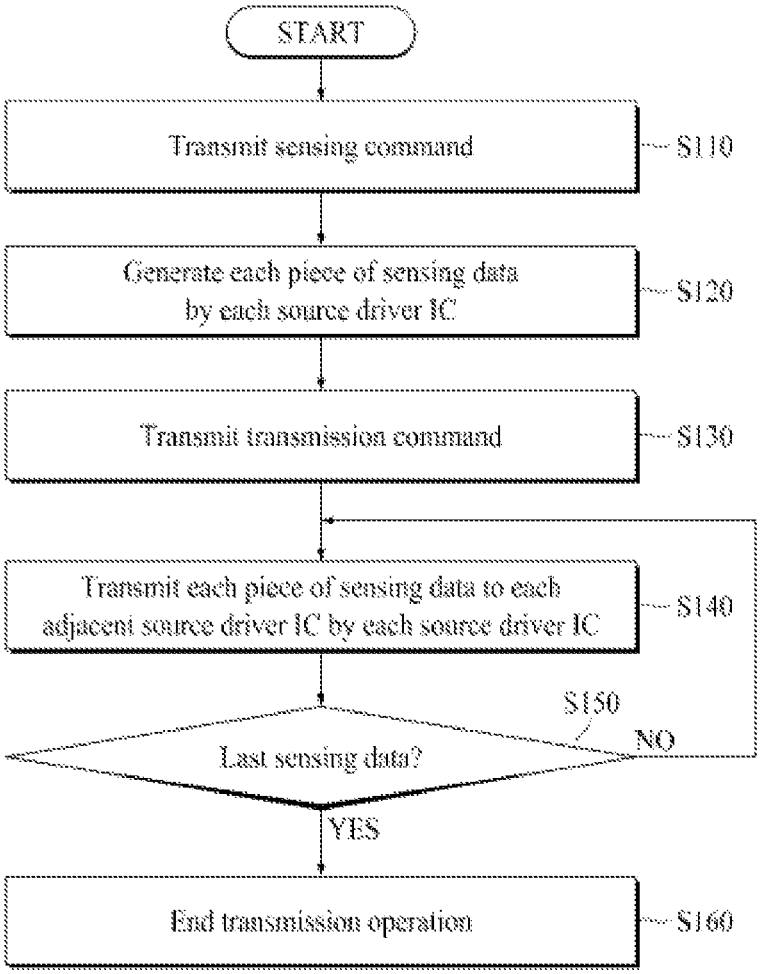
FIG. 8 is a flowchart illustrating an operation of a display device including the timing controller and the source driver ICs according to one embodiment of the present disclosure.

FIG. 8 is a flowchart illustrating an operation of a display device including the timing controller and the source driver ICs according to the embodiment of the present disclosure.

Referring to FIGS. 1 to 8, for a sensing operation, a packet generator 115 of a timing controller 110 generates a packet CEDSP or CDATA including a sensing command instructing the performance of the sensing operation and transmits the packet to each of source driver ICs (S110).

A control circuit of each of the source driver ICs generates control signals corresponding to the sensing command included in the packet CEDSP or CDATA, and a sensing data generation circuit of each source driver IC receives sensing signals from pixels included in each pixel group connected (or assigned) to each of the source driver ICs in response to the control signals, generates sensing data corresponding to the sensing signals (e.g., self-sensing data), and stores the self-sensing data in a second buffer of each of the source driver ICs (S120).

The packet generator 115 of the timing controller 110 generates the packet CEDSP or CDATA including a transmission command instructing a transmission operation and transmits the packet to each of the source driver ICs (S130).

As described with reference to FIG. 5, each of the source driver ICs transmits the self-sensing data to the next source driver IC on the basis of the transmission command included in the packet CEDSP or CDATA in a first transmission operation TO1, and transmits transmission sensing data transmitted from the previous source driver IC to the next source driver IC on the basis of the transmission command included in the packet CEDSP or CDATA in each transmission operation TO2, TO3, . . . , or TO7 (S140 and in a case "NO" in S150).

In a last transmission operation TO8, each of the source driver ICs transmits the transmission sensing data transmitted from the previous source driver IC to the next source driver IC (S140 and in a case "YES" in S150), and ends the transmission operation (S160).

According to the present disclosure, a timing controller receives sensing data of a plurality of source driver ICs through some source driver ICs unlike a conventional timing controller which receives sensing data from each of source driver ICs and thus is required to perform a tuning operation to match phases of clock signals output from the source driver ICs, and thus there is an effect that a separate tuning operation for matching phases of clock signals is not required to be performed.

Further, according to the present disclosure, since only some source driver ICs of a plurality of source driver ICs transmit clock signals and sensing data to a timing controller, the number of wires, which are formed on a board of a display device to transmit the clock signal and the sensing data to the timing controller, can be reduced as compared to the number of wires formed on a board of a conventional display device, and thus there is an effect that the size of the board of the display device can be reduced.

Further, according to the present disclosure, since the number of wires formed on a board is reduced as compared to the number of wires formed in a conventional board, the number of wires included in a cable connected between the board and a timing controller can be reduced, and thus there is an effect that the size of the cable can be reduced.

What is claimed is:

1. A source driver IC comprising:

a first buffer in which first sensing data transmitted from a first source driver IC is stored;

a sensing data generation circuit configured to sense a characteristic of a driving element included in each pixel and generate second sensing data;

a second buffer in which the second sensing data is stored;

a control circuit configured to generate a selection signal in response to an operation command; and a selector configured to transmit one of the first sensing data stored in the first buffer and the second sensing data stored in the second buffer to a second source driver IC in response to the selection signal, wherein, when a first transmission command is received from a timing controller, the selector is configured to transmit the second sensing data to the second source driver IC, and the second source driver IC is configured to transmit third sensing data generated by the second source driver IC to the timing controller, and wherein, when a second transmission command is received from the timing controller, the selector is configured to transmit the first sensing data to the second source driver IC and the second source driver IC is configured to transmit the second sensing data, which is transmitted from the selector, to the timing controller.

2. The source driver IC of claim 1, further comprising:

a first pin configured to receive the first sensing data;

a second pin configured to receive a first clock signal related to transmission of the first sensing data;

a third pin connected to an output terminal of the selector to transmit one of the first sensing data and the second sensing data to the second source driver IC; and a fourth pin configured to transmit a second clock signal related to transmission of the second sensing data to the second source driver IC.

3. The source driver IC of claim 2, further comprising a clock embedded data signaling (CEDS) control packet receiving pin configured to receive a CEDS control packet which includes the operation command and is output from the timing controller.

4. The source driver IC of claim 2, wherein the second clock signal is determined according to a clock signal included in a CEDS control packet conforming to a CEDS protocol.

5. The source driver IC of claim 2, further comprising:

a data packet receiving pin configured to receive a data packet (CDATA) that includes the operation command and is output from a timing controller; and a reference clock receiving pin configured to receive a reference clock signal (ACLK) that is output from the timing controller and related to transmission of the data packet (CDATA).

6. The source driver IC of claim 5, wherein the control circuit generates the second clock signal according to the reference clock signal (ACLK).

7. A display device comprising a data driving circuit block including a plurality of source driver ICs each configured to sense a characteristic of a driving element included in each pixel and obtain sensing data, wherein each of the plurality of source driver ICs includes a first source driver IC connected to a first pixel and configured to transmit first sensing data, which is obtained by sensing a characteristic of a driving element included in the first pixel, to a timing controller when a first transmission command is received from the timing controller, and a second source driver IC connected to a second pixel and configured to transmit second sensing data, which is obtained by sensing a characteristic of a driving element included in the second pixel, to the first source driver IC when the first transmission command is received, wherein, when a second transmission command is received from the timing controller, the first source driver IC is configured to transmit the second sensing data, received from the second source driver IC, to the timing controller and the second source driver IC is configured to transmit a third sensing data received from a third source driver or dummy data to the first source driver IC.

8. The display device of claim 7, wherein the plurality of source driver ICs are connected in a cascade manner for transmission of the sensing data.

9. The display device of claim 7, wherein the data driving circuit block further includes a board connected to the first and second source driver ICs, wherein the board includes a first wire for transmitting the second sensing data transmitted from the second source driver IC to the first source driver IC and a second wire for transmitting a clock signal, which is output from the second source driver IC and related to transmission of the second sensing data, to the first source driver IC.

10. The display device of claim 7, further comprising the timing controller configured to generate a control command including one of a sensing command for causing the plurality of source driver ICs to obtain the sensing data, the first transmission command, and the second transmission command and transmit the control command to the plurality of source driver ICs.

11. The display device of claim 10, wherein the timing controller generates the control command in the form of a control packet conforming to a clock embedded data signaling (CEDS) protocol, and the plurality of source driver ICs output an output clock signal, which is determined on the basis of a clock signal included in the control packet, together with the sensing data.

12. The display device of claim 10, wherein the timing controller generates the control command in the form of a data packet (CDATA) and transmits a reference clock signal (ACLK) related to transmission of the data packet (CDATA) to the plurality of source driver ICs in a point-to-point manner.

13. The display device of claim 12, wherein the plurality of source driver ICs generate an output clock signal related to transmission of the sensing data according to the reference clock signal (ACLK) and output the sensing data using the output clock signal.

14. The display device of claim 10, wherein the timing controller is connected to the plurality of source driver ICs in a point-to-point manner to transmit the control command thereto, and the first source driver IC is connected to the timing controller in a point-to-point manner to transmit the first sensing data thereto.

15. A method of operating a display device comprising a timing controller, a first source driver IC connected to a first pixel group, and a second source driver IC connected to a second pixel group, the method comprising:

generating first sensing data by sensing pixels included in the first pixel group by the first source driver IC and generating second sensing data by sensing pixels included in the second pixel group by the second source driver IC in response to a sensing command output from the timing controller;

transmitting the first sensing data to the timing controller by the first source driver IC and transmitting the second sensing data to the first source driver IC by the second source driver IC in response to a first transmission command output from the timing controller; and transmitting the second sensing data, which is transmitted from the second source driver IC, to the timing controller by the first source driver IC in response to a second transmission command output from the timing controller.

16. The method of claim 15, further comprising:

generating a first clock signal related to transmission of the first sensing data according to a reference clock signal output from the timing controller and transmitting the first clock signal and the first sensing data to the timing controller by the first source driver IC; and generating a second clock signal related to transmission of the second sensing data according to the reference clock signal and transmitting the second clock signal and the second sensing data to the first source driver IC by the second source driver IC.

* * * * *